313-422 SR
8/11/81 OR 4,283,654

United States Patent [19]
van Raalte

[11] 4,283,654
[45] Aug. 11, 1981

[54] MODULAR TUBE SHADOW MASK SUPPORT SYSTEM

[75] Inventor: John A. van Raalte, Princeton, N.J.
[73] Assignee: RCA Corporation, New York, N.Y.

[21] Appl. No.: 33,966
[22] Filed: Apr. 27, 1979
[51] Int. Cl.[3] ..... H01J 29/07; H01J 31/20
[52] U.S. Cl. ..... 313/422
[58] Field of Search ..... 313/422, 403, 402, 407, 313/404, 405, 406, 422

[56] References Cited

U.S. PATENT DOCUMENTS

| | | | |
|---|---|---|---|
| 3,497,746 | 2/1970 | Duistermaat et al. | 313/404 |
| 3,735,179 | 5/1973 | Kaplan | 313/408 |
| 3,796,904 | 3/1974 | Yamauchi et al. | 313/404 |
| 3,943,399 | 3/1976 | Sedivy | 313/404 |
| 4,028,582 | 6/1977 | Anderson et al. | 313/422 |
| 4,072,876 | 2/1978 | Morrell | 313/403 |
| 4,145,633 | 3/1979 | Peters et al. | 313/400 |

*Primary Examiner*—Robert Segal
*Attorney, Agent, or Firm*—Eugene M. Whitacre; Glenn H. Bruestle; Vincent J. Coughlin, Jr.

[57] ABSTRACT

A display device includes an evacuated envelope having a mosaic phosphor screen deposited on a front wall. A substantially rectangular frameless shadow mask having mounting means extending from two oppositely disposed edges of the shadow mask is in spaced, parallel relation to the screen. A shadow mask suspension system includes at least two mutually parallel support bars disposed on the front wall beyond the screen area. Shadow mask mounting means slots are in the distal surface of the support bars. A locking member engages each of the support bars to retain the mounting means within the slots.

5 Claims, 6 Drawing Figures

MODULAR TUBE SHADOW MASK SUPPORT SYSTEM

BACKGROUND OF THE INVENTION

The present invention relates to a flat panel display device of the type having a plurality of parallel internal support walls which partition the device into a plurality of channels, and particularly to a structure for supporting a shadow mask in such a device.

U.S. Pat. No. 4,028,582 issued to Anderson et al. on June 7, 1977 and entitled "Guided Beam Flat Display Device," and now the subject of reissue application Ser. No. 862,188, filed Dec. 19, 1977, discloses a shadow mask extending across each of the channels and mounted on the internal support walls. Details of how the shadow mask is supported on the support walls are not disclosed.

U.S. Pat. No. 4,145,633 issued to Peters et al. on Mar. 20, 1979 and entitled "Modular Guided Beam Flat Display Device" discloses a shadow mask extending between the internal support walls and metal tips so that the shadow mask is secured in spaced, parallel relation to the phosphor screen. A drawback of the Peters et al. structure is the complex retaining structure required to maintain the shadow mask between the metal tips and the support walls.

SUMMARY OF THE INVENTION

A display device includes an evacuated envelope having a mosaic phosphor screen deposited on a front wall. A frameless shadow mask having mounting means extending from two oppositely disposed edges of the shadow mask is in spaced, parallel relation to the screen. A shadow mask suspension system having shadow mask mounting means slots is disposed on the envelope beyond the screen area. Means is provided for securing the mounting tabs within the mounting slots.

DETAILED DESCRIPTION OF THE PREFERRED EMBODIMENT

Figure 1:
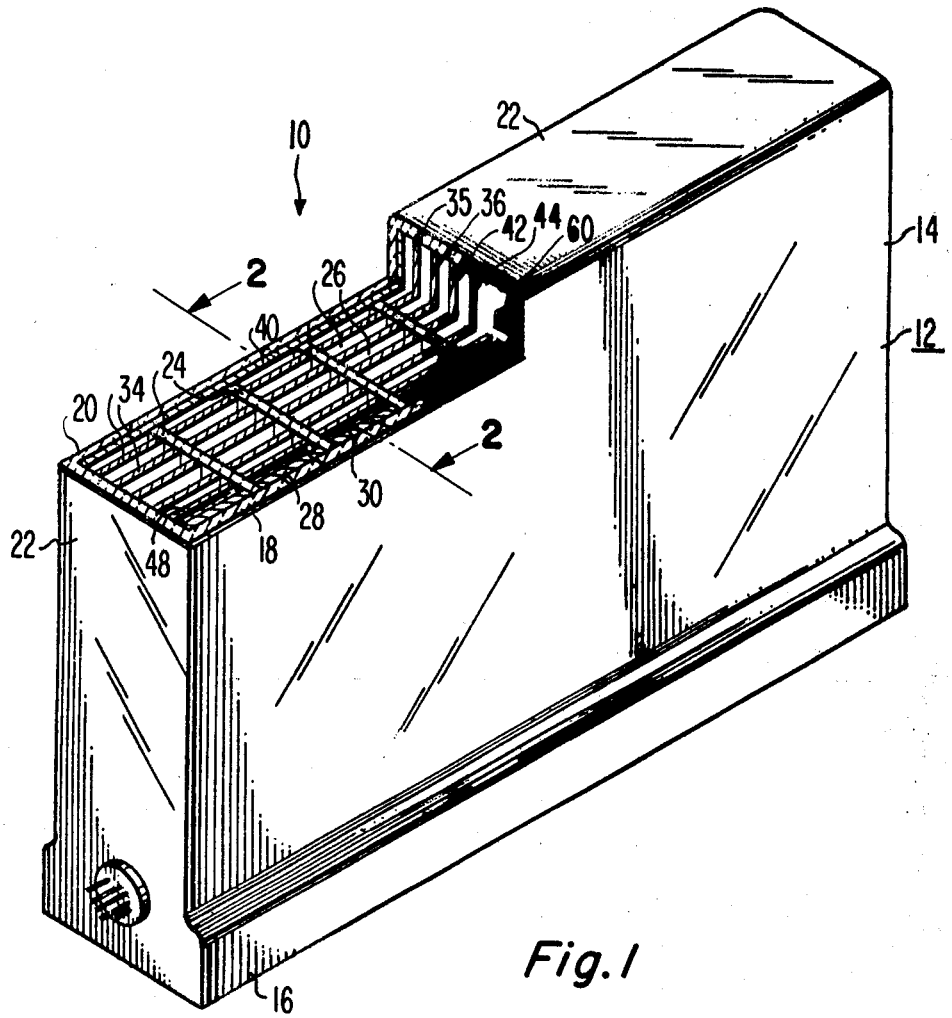
FIG. 1 is a perspective view partially broken away of a flat panel display device into which the present invention can be incorporated.
Figure 2:
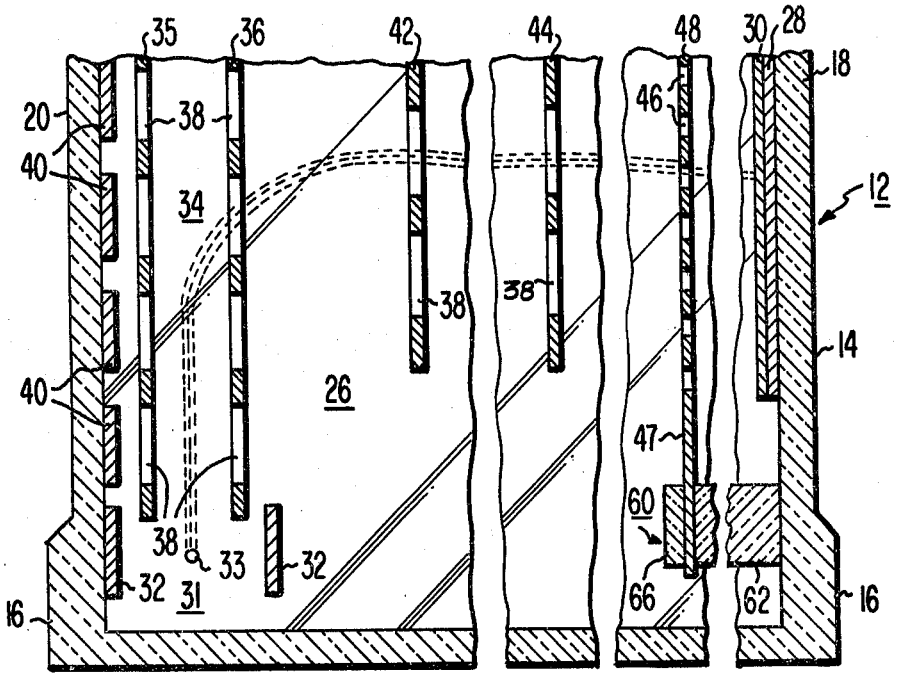
FIG. 2 is an enlarged sectional view taken along line 2—2 of FIG. 1.

Referring to FIGS. 1 and 2, one form of a flat display device utilizing the shadow mask support structure of the present invention is generally designated as 10. The display device 10 comprises an evacuated envelope 12, typically of glass, having a display section 14 and an electron gun section 16. The display section 14 includes a rectangular front wall 18 and a rectangular back wall 20 in spaced, parallel relation with the front wall 18. The front wall 18 and back wall 20 are connected by side walls 22. The front wall 18 and back wall 20 are dimensioned to provide the size of the display desired, e.g., 75 to 100 cm and are spaced about 2.5 to 7.5 cm.

A plurality of spaced, parallel support walls 24 extend between the front wall 18 and the back wall 20 and from the gun section 16 toward the opposite side wall 22. The support walls 24 provide the desired internal support for the evacuated envelope 12 against external atmospheric pressure and divide the display section 14 into a plurality of channels 26. On the inner surface of the front wall 18 is a phosphor screen 28. The phosphor screen 28 may be of any well known type presently being used in cathode ray tubes, e.g., black and white or color television display tubes. In color display tubes, the screen may be any one of a number of mosaic type phosphor screens. Preferably, the screen 28 comprises three interlaced arrays of different color emitting phosphor lines separated by a light-absorbing matrix: A metal film electrode 30 is provided on the phosphor screen 28.

The gun section 16 is an extension of the display section 14 and extends along one end of the channels 26. The gun section may be of any shape suitable to enclose a particular gun structure 31 contained therein. The electron gun structure 31 contained in the gun section 16 may be of any well known construction suitable for generating three beams of electrons into each of the channels 26. For example, the gun structure may comprise a plurality of individual guns mounted at the ends of the channels 26 for directing separate beams of electrons into the channels. Alternatively, the gun structure 31 may include a plurality of modulation electrodes 32 and a line cathode 33 extending along the gun section 16 between the modulation electrodes 32. The line cathode 33 also extends across the ends of the channels 26 and is adapted to generate electrons which can be selectively directed as individual beams into the channels. A gun structure of the line type is described in U.S. Pat. No. 4,121,130 issued to R. A. Gange on Oct. 17, 1978 and entitled "Cathode Structure and Method of Operating the Same."

In each of the channels 26 is a beam guide 34 for focusing and periodically confining electrons into beams which travel in a path along the guide 34. The guide 34 includes a pair of elongated, spaced apart, parallel first and second guide grids 35 and 36 respectively, each having an array of apertures 38 therethrough. The apertures 38 are arranged so as to define a plurality of rows transversely across and columns longitudinally along the guide grids 35 and 36. A plurality of spaced, parallel conductors 40 are disposed on the inner surface of the back wall 20 and extend transversely across the channels 26. The conductors 40 are strips of an electrically conductive material, such as metal, coated on the back wall 20. Each of the conductors 40 lies directly opposite a transverse row of apertures 38 in the first guide grid 35. Means are provided for deflecting the beam out of the guide and toward the phosphor screen 28 at various points along the length of the channels 26.

In each of the channels 26 a focusing grid 42 may be located in spaced relation between the beam guide 34 and the metal film electrode 30 on the phosphor screen 28. An accelerating grid 44 may be interposed between the focusing grid 42 and the metal film electrode 30. The focusing grid 42 and the accelerating grid 44 also have a plurality of apertures 38 therethrough. Grids 42 and 44 serve as focusing and accelerating means, respectively, for the electron beams as the beams flow from the beam guide 34 to the phosphor screen 28. An apertured, frameless, rectangular shadow mask 48 is positioned in the envelope 12, adjacent to the front wall 18 in spaced parallel relation to the phosphor screen 28. The shadow mask 48 may comprise a plurality of discrete individual mask segments 48*a*, e.g., one mask segment per channel, as described in my copending application entitled "Segmented Shadow Mask," filed concurrently herewith. The shadow mask 48 extends across the channels 26 along substantially the entire length of the channels 26 between the support walls 24, unrestricted by the support walls. The mask 48 serves as a color selection electrode for electron beams flowing from the beam guide 34 to the phosphor screen 28.

Figure 3:
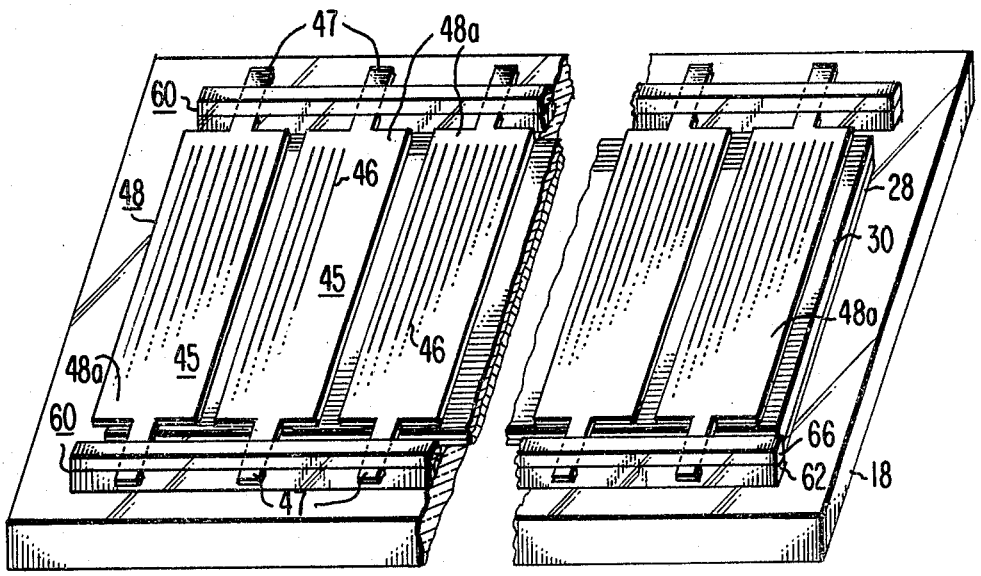
FIG. 3 is a partial perspective view of the mask-support structure of FIG. 2.

As shown in FIGS. 2–3, the shadow mask 48 is secured by mounting means, e.g., tabs 47, to a shadow mask suspension system 60, located at the two oppositely disposed edges of the mask, which extend along the channels.

The shadow mask is formed from a sheet of metal such as cold rolled steel and includes an active portion 45, having an array of elongated apertures 46 therein. The active portion is that portion which overlies the phosphor screen 28 and provides the shadowing or color selection function. For a phosphor screen 28 made up of spaced longitudinally extending strips, the apertures 46 are arranged in longitudinally extending vertical columns parallel to the phosphor strips. The column-to-column spacing between the apertures 46 is equal across each of the channels 26.

Of principal concern in any embodiment having a vertical line screen 28 and a mask 48 having elongated apertures 46 is the prevention, or at least minimization, of the effective horizontal motion of the mask. Such motion can be caused by thermal expansion of the mask 48 in the horizontal direction, that is, the direction of high frequency scan. Motion of the mask in the vertical direction is of little consequence since the mask apertures 46 and the phosphor strips on the line screen 28 will still remain aligned. In the preferred embodiment shown in FIGS. 3 and 4, the minimization of the effective horizontal motion of the mask 48 is achieved by fabricating the mask 48 as a plurality of discrete identical mask segments 48*a*, as described in my copending application entitled "Segmented Shadow Mask." Each of the mask segments 48*a* spans one of the channels 26. For example, if each of the channels 26 has a horizontal dimension of about 2.5 cm, the thermal expansion of each of the mask segments 48*a* in the horizontal dimension is negligible for all operating conditions of the display device and horizontal registration between the mask apertures 46 and the phosphor strips on the line screen 28 is assured.

Each of the mask segments 48*a* is coplanar with, adjacent to, and spaced apart from at least one of the other mask segments 48*a*. The spacing between adjacent mask segments 48*a* is sufficient to permit one of the support walls 24 (not shown) to pass therebetween without contacting the shadow mask segments 48*a*.

Figure 4:
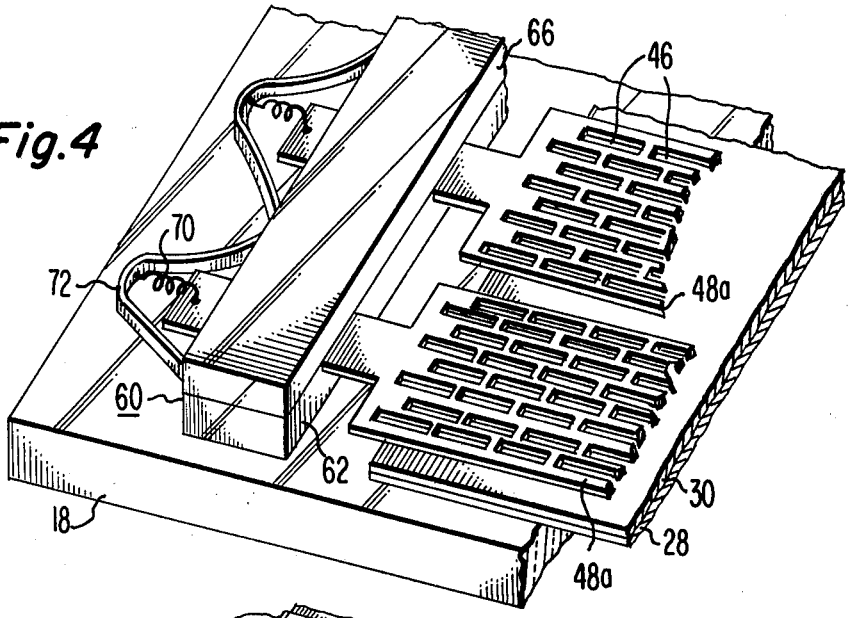
FIG. 4 is an enlarged partial perspective view of the mask-support structure of FIG. 2 including the shadow-mask tension springs.
Figure 5:
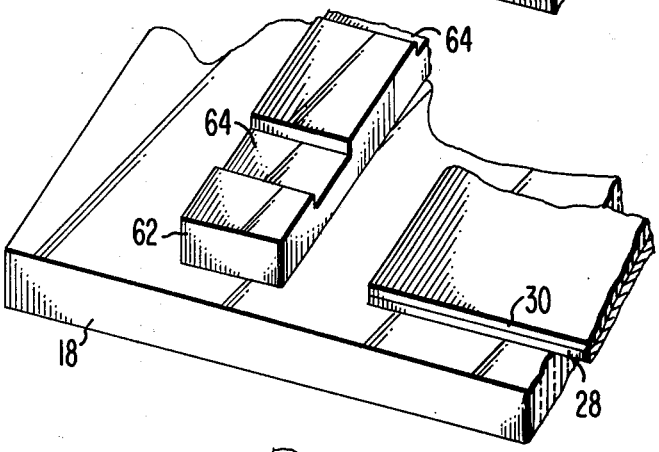
FIG. 5 is an enlarged partial perspective view of the support bar of FIG. 4.

Interconnection between the mask segments 48*a* and the front wall 18 is made by means of a novel shadow mask suspension system 60. An enlarged partial perspective view of the suspension system 60 and the mask segment 48*a* is shown in FIGS. 4 and 5. The suspension system 60 comprises two support bars 62 either integral with or fixedly attached, in substantially mutual parallel relation, to the front wall 18 on opposite sides, viz. top and bottom, of the phosphor screen 28. The support bars 62 have their major axes aligned parallel to the direction of high frequency scan, which is the horizontal direction. The support bars 62 may be made of glass or another suitable material having a coefficient of thermal expansion that is substantially equal to that of the front wall 18. As shown in FIG. 5, a plurality of slots 64 are formed in the distal surface of each of the support bars 62. The slots 64 have a dimension along the direction of high frequency scan which is sufficient to accommodate the shadow mask mounting tabs 47 extending from the vertical edges of the shadow mask segments 48*a*, as shown in FIG. 4, so that horizontal registration between the apertures 46 of the mask segments 48*a* and the phosphor strips of the line screen 28 is assured.

Alternatively, the support bars 62 may comprise a plurality of individual bars either integral with or fixedly attached to the front wall 18 of the envelope on opposite sides of the phosphor screen 28 and aligned parallel to the direction of high frequency scan. Each of the bars has at least one slot 64 in the distal surface thereof to accommodate one of the shadow mask mounting tabs so that horizontal registration between the apertures 46 of the mask segments 48*a* and the phosphor strips of the line screen 28 is assured.

The perpendicular spacing between the shadow mask segments 48*a* and the screen 28 which is generally known as the "q" spacing, may be accurately maintained for each of the shadow mask segments 48*a* by requiring that the spacing between the bottom of the slots 64 on the support bars 62 and the faceplate 18 be substantially equal and dimensioned to provide the desired "q" spacing. It has also been determined that the depth of the slots should be substantially equal to the thickness of the shadow mask mounting tabs 47 to facilitate securing the mask supports 48*a* to the suspension system 60 and to ensure that the "q" spacing remains fixed regardless of the faceplate orientation.

As shown in FIGS. 2–4, locking bars 66 may be attached to the distal surface of each of the support bars 62 to slidably retain the shadow mask mounting tabs 47 within the support bar slots 64 (not shown). Clearly, the mounting tabs 47 at only one edge of the mask segments 48*a* are required to slide in the slots 64 to allow for thermal expansion in the vertical direction. The mounting tab at the other edge of the mask segment may be fixedly attached to the suspension system 60. The locking bars 66 may comprise a single member extending along substantially the entire distal surface of each support bar 62 or a plurality of locking members which engage each of the support bars 62 to retain the mounting tabs 47 within the slots 64 of each of the support bars 62.

Vertical position of the mask segments 48*a* with respect to the screen 28 is held by means of a biasing means including tension springs 70 and spring supports 72 attached to the mounting tabs 47 as shown in FIG. 4.

Figure 6:
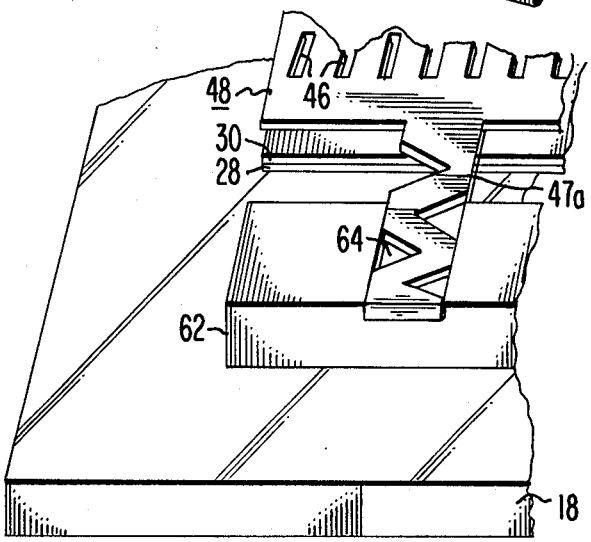
FIG. 6 is an enlarged partial perspective view of an integral shadow mask tension spring.

As shown in FIG. 4, the tension springs used to position the mask segments in the vertical position may be a plurality of discrete springs 70 connected to the mounting tabs 47 so as to apply tension perpendicular to the direction of the high frequency scan. Alternatively, as shown in FIG. 6, the tension springs may be integral springs 47*a* etched into the mounting tabs 47 and positioned within the support bar slots 64. The etched springs 47*a* may be included in the photomaster patterns used to expose the mask apertures described in my copending application entitled "Segmented Shadow Mask." Locking member 66 may be attached to the distal surface of the support bars 62 to retain the etched springs 47*a* within the slots 64 of support bars 62.

Although the foregoing embodiments are described with respect to a flat shadow type tube wherein a mask and screen are held at the same electrical potential, it should be understood that the present invention is also applicable to other shadow mask type tubes such as to a tube where the mask and screen are held at different potentials. Such tubes are also known as focus mask or focus shadow mask tubes.

I claim:

1. In a display device having an evacuated envelope with a front wall and a screen on the internal surface of said front wall, an electron generating means, and a segmented shadow mask spaced from said screen, a shadow mask suspension system comprising:

a plurality of elongated support members arranged along said front wall on opposite sides of said screen and substantially parallel to one dimension of said screen, each of said support members including a plurality of slots substantially equally spaced along said one dimension;

said shadow mask including a plurality of segments, each of said segments having mounting tabs at both ends, said tabs being dimensioned substantially equally to said slots and engaging said slots to prevent motion of said segments in said one direction, each of said segments bridging said screen in the other dimension of said screen and said segments cumulatively spanning said screen in said one direction, said support members supporting said segments a predetermined distance above said screen to establish the q spacing of said display device.

2. The suspension system of claim 1 wherein the depth of said slots is substantially equal to the thickness of said tabs.

3. The suspension system of claim 2 further including locking bars extending along said support members to lock said tabs into said slots.

4. The suspension system of claim 3 wherein said segments are spaced apart and said display device further includes support walls arranged between said segments to divide said envelope into a plurality of channels, each of said segments spanning one of said channels.

5. The suspension system of claim 1 or 4 wherein said support members are bars extending the dimension of said screen in said one direction.

* * * * *